US008734003B2

(12) United States Patent
Aizenberg et al.

(10) Patent No.: US 8,734,003 B2
(45) Date of Patent: May 27, 2014

(54) MICRO-CHEMICAL MIXING

(75) Inventors: Joanna Aizenberg, New Providence, NJ (US); Paul Robert Kolodner, Hoboken, NJ (US); Thomas Nikita Krupenkin, Warren, NJ (US)

(73) Assignee: Alcatel Lucent, Paris (FR)

( * ) Notice: Subject to any disclaimer, the term of this patent is extended or adjusted under 35 U.S.C. 154(b) by 1307 days.

(21) Appl. No.: 11/319,865

(22) Filed: Dec. 27, 2005

(65) Prior Publication Data

US 2007/0056853 A1 Mar. 15, 2007

Related U.S. Application Data

(63) Continuation-in-part of application No. 11/227,759, filed on Sep. 15, 2005.

(51) Int. Cl.
*B01F 13/00* (2006.01)

(52) U.S. Cl.
USPC ..... 366/127; 366/348; 366/349; 204/164; 422/186.04

(58) Field of Classification Search
USPC ..... 200/200, 201, 208, 233, 234, 235; 366/127, 348, 349; 204/450, 547, 667, 204/164; 422/186.04
See application file for complete search history.

(56) References Cited

U.S. PATENT DOCUMENTS 3,268,320 A * 8/1966 Penberthy ..... 65/178
3,454,686 A 7/1969 Jones
3,670,130 A 6/1972 Greenwood
4,030,813 A 6/1977 Kohashi et al.
4,118,270 A 10/1978 Pan et al.
4,137,060 A 1/1979 Timmermann
4,338,352 A 7/1982 Bear et al.
4,341,310 A * 7/1982 Sangiovanni et al. ..... 209/638
4,390,403 A * 6/1983 Batchelder ..... 204/547
4,406,732 A 9/1983 Kayoun
4,569,575 A 2/1986 Le Pesant et al.
4,583,824 A * 4/1986 Lea ..... 359/223.1
4,653,847 A 3/1987 Berg et al.
4,671,609 A 6/1987 Khoe et al.
4,708,426 A 11/1987 Khoe et al.
4,783,155 A 11/1988 Imataki et al.

(Continued)

FOREIGN PATENT DOCUMENTS

DE 19623270 A 1/1998
DE 197 05 910 6/1998

(Continued)

OTHER PUBLICATIONS

Krupenkin et al. From rolling ball to complete wetting: the dynamic tuning of liquids on nanostructured surfaces. Langmuir 20 (2004) 3824-3827. Including Supporting Information section, published on Langmuir's website.*

(Continued)

*Primary Examiner* — Tony G Soohoo
(74) *Attorney, Agent, or Firm* — Hitt Gaines, PC.

(57) ABSTRACT

A method comprising, providing a droplet having a first chemical species and a second chemical species on a substrate, and applying a voltage across the droplet to physically repeatedly deform the droplet. In this embodiment, the applying causes the droplet to move with respect to an object located therein and at least partially mix the first chemical species and the second chemical species.

21 Claims, 8 Drawing Sheets

(56) References Cited

U.S. PATENT DOCUMENTS

| | | | | |
|---|---|---|---|---|
| 4,784,479 | A | 11/1988 | Ikamori | |
| 4,867,521 | A | 9/1989 | Mallinson | |
| 4,948,214 | A | 8/1990 | Hamblen | |
| 5,248,734 | A | 9/1993 | Ober et al. | |
| 5,348,687 | A | 9/1994 | Beck et al. | |
| 5,412,746 | A | 5/1995 | Rossberg et al. | |
| 5,427,663 | A * | 6/1995 | Austin et al. | 204/549 |
| 5,428,711 | A | 6/1995 | Akiyama et al. | |
| 5,486,337 | A | 1/1996 | Ohkawa | |
| 5,518,863 | A | 5/1996 | Pawluczyk | |
| 5,659,330 | A * | 8/1997 | Sheridon | 345/84 |
| 5,665,527 | A | 9/1997 | Allen et al. | |
| 5,716,842 | A | 2/1998 | Baier et al. | |
| 5,731,792 | A * | 3/1998 | Sheridon | 345/84 |
| 5,922,299 | A | 7/1999 | Bruinsma et al. | |
| 5,948,470 | A | 9/1999 | Harrison et al. | |
| 6,014,259 | A | 1/2000 | Wohlstadter | |
| 6,027,666 | A | 2/2000 | Ozin et al. | |
| 6,185,961 | B1 | 2/2001 | Tonucci et al. | |
| 6,200,013 | B1 * | 3/2001 | Takeuchi et al. | 366/162.4 |
| 6,232,129 | B1 * | 5/2001 | Wiktor | 436/180 |
| 6,284,546 | B1 * | 9/2001 | Bryning et al. | 436/172 |
| 6,294,137 | B1 * | 9/2001 | McLaine | 422/186.04 |
| 6,319,427 | B1 | 11/2001 | Ozin et al. | |
| 6,329,070 | B1 | 12/2001 | Sass et al. | |
| 6,369,954 | B1 | 4/2002 | Berge et al. | |
| 6,379,874 | B1 | 4/2002 | Ober et al. | |
| 6,387,453 | B1 | 5/2002 | Brinker et al. | |
| 6,409,907 | B1 | 6/2002 | Braun et al. | |
| 6,465,387 | B1 | 10/2002 | Pinnavaia et al. | |
| 6,471,761 | B2 | 10/2002 | Fan et al. | |
| 6,473,543 | B2 | 10/2002 | Bartels | |
| 6,538,823 | B2 | 3/2003 | Kroupenkine et al. | |
| 6,545,815 | B2 | 4/2003 | Kroupenkine et al. | |
| 6,545,816 | B1 | 4/2003 | Kroupenkine et al. | |
| 6,665,127 | B2 | 12/2003 | Bao et al. | |
| 6,747,123 | B2 | 6/2004 | Chen et al. | |
| 6,778,328 | B1 | 8/2004 | Aizenberg et al. | |
| 6,790,330 | B2 * | 9/2004 | Gascoyne et al. | 204/547 |
| 6,829,415 | B2 | 12/2004 | Kroupenkine et al. | |
| 6,847,493 | B1 | 1/2005 | Davis et al. | |
| 6,891,682 | B2 | 5/2005 | Aizenberg et al. | |
| 6,936,196 | B2 | 8/2005 | Chandross et al. | |
| 6,965,480 | B2 | 11/2005 | Kroupenkine et al. | |
| 7,005,593 | B2 | 2/2006 | Gasparyan et al. | |
| 7,008,757 | B2 | 3/2006 | Reichmanis et al. | |
| 7,048,889 | B2 | 5/2006 | Arney et al. | |
| 7,106,519 | B2 | 9/2006 | Aizenberg et al. | |
| 7,110,646 | B2 | 9/2006 | Eggleton et al. | |
| 7,156,032 | B2 | 1/2007 | Kornblit et al. | |
| 7,168,266 | B2 | 1/2007 | Chen et al. | |
| 7,172,736 | B2 | 2/2007 | Kawamura et al. | |
| 7,204,298 | B2 * | 4/2007 | Hodes et al. | 165/80.4 |
| 7,211,223 | B2 * | 5/2007 | Fouillet et al. | 422/514 |
| 7,227,235 | B2 | 6/2007 | Kroupenkine et al. | |
| 7,255,780 | B2 * | 8/2007 | Shenderov | 204/450 |
| 7,507,433 | B2 * | 3/2009 | Weber | 427/2.1 |
| 7,611,614 | B2 * | 11/2009 | Reel et al. | 204/450 |
| 7,618,746 | B2 | 11/2009 | Kroupenkine et al. | |
| 7,749,646 | B2 | 7/2010 | Hodes et al. | |
| 7,767,069 | B2 * | 8/2010 | Lee et al. | 204/450 |
| 7,780,830 | B2 * | 8/2010 | Haluzak et al. | 204/450 |
| 7,785,733 | B2 | 8/2010 | Hodes et al. | |
| 7,875,160 | B2 * | 1/2011 | Jary | 204/450 |
| 8,124,423 | B2 | 2/2012 | Hodes et al. | |
| 2001/0036669 | A1 * | 11/2001 | Jedrzejewski et al. | 436/94 |
| 2002/0125192 | A1 | 9/2002 | Lopez et al. | |
| 2002/0196558 | A1 * | 12/2002 | Kroupenkine et al. | 359/665 |
| 2003/0020915 | A1 | 1/2003 | Schueller et al. | |
| 2003/0038032 | A1 * | 2/2003 | Reel et al. | 204/643 |
| 2003/0129501 | A1 | 7/2003 | Megens et al. | |
| 2003/0148401 | A1 | 8/2003 | Agrawal et al. | |
| 2003/0183525 | A1 * | 10/2003 | Elrod et al. | 204/547 |
| 2003/0227100 | A1 * | 12/2003 | Chandross et al. | 264/1.36 |
| 2004/0018129 | A1 | 1/2004 | Kawamura et al. | |
| 2004/0031688 | A1 * | 2/2004 | Shenderov | 204/600 |
| 2004/0055891 | A1 * | 3/2004 | Pamula et al. | 205/98 |
| 2004/0058450 | A1 * | 3/2004 | Pamula et al. | 436/150 |
| 2004/0136876 | A1 * | 7/2004 | Fouillet et al. | 422/100 |
| 2004/0191127 | A1 * | 9/2004 | Kornblit et al. | 422/100 |
| 2004/0210213 | A1 * | 10/2004 | Fuimaono et al. | 606/41 |
| 2004/0211659 | A1 * | 10/2004 | Velev | 204/164 |
| 2005/0039661 | A1 | 2/2005 | Kornblit et al. | |
| 2005/0069458 | A1 | 3/2005 | Hodes et al. | |
| 2005/0115836 | A1 * | 6/2005 | Reihs | 204/450 |
| 2005/0203613 | A1 | 9/2005 | Arney et al. | |
| 2005/0211505 | A1 | 9/2005 | Kroupenkine et al. | |
| 2006/0108224 | A1 * | 5/2006 | King et al. | 204/450 |
| 2006/0172189 | A1 * | 8/2006 | Kolodner et al. | 429/129 |
| 2007/0048858 | A1 * | 3/2007 | Aizenberg et al. | 435/287.2 |
| 2007/0056853 | A1 * | 3/2007 | Aizenberg et al. | 204/547 |
| 2007/0058483 | A1 | 3/2007 | Aizenberg et al. | |
| 2007/0059213 | A1 * | 3/2007 | Aizenberg et al. | 422/99 |
| 2007/0059489 | A1 * | 3/2007 | Hodes et al. | 428/141 |
| 2007/0237025 | A1 * | 10/2007 | Krupenkin et al. | 366/127 |
| 2007/0272528 | A1 * | 11/2007 | Gasparyan et al. | 200/181 |
| 2008/0137213 | A1 * | 6/2008 | Kuiper et al. | 359/666 |
| 2009/0260988 | A1 * | 10/2009 | Pamula et al. | 204/450 |
| 2010/0110532 | A1 * | 5/2010 | Takemoto et al. | 359/316 |
| 2010/0116656 | A1 * | 5/2010 | Garcia Tello et al. | 204/450 |

FOREIGN PATENT DOCUMENTS

| | | |
|---|---|---|
| DE | 197 04 207 A1 | 8/1998 |
| EP | 0 290 125 | 11/1988 |
| EP | 1120164 | 8/2001 |
| FR | 2769375 | 4/1999 |
| WO | WO 99/18456 | 4/1999 |
| WO | 99/54730 | 10/1999 |
| WO | 01/31404 A1 | 5/2001 |
| WO | WO 01/42540 | 6/2001 |
| WO | 01/51990 | 7/2001 |
| WO | 03/056330 | 7/2003 |
| WO | 03/071335 | 8/2003 |
| WO | 03/083447 | 10/2003 |
| WO | 03/103835 | 12/2003 |

OTHER PUBLICATIONS

Krupenkin et al. From rolling ball to complete wetting on dynamically tunable nanostructured surfaces. Abstract Y22.006. Abstracts, meeting of the American Physical Society in Montreal, Canada, Mar. 22-26, 2004.*

Bell Labs scientists discover technique to control fluids using specially fabricated silicon "nanograss". Lucent Technologies, press release Mar. 12, 2004. No longer available on Lucent's press archive, but available through the Internet Archive.*

Super-repellent surface switches on and off. P. Weiss, Science News, Apr. 24, 2004.*

'Nanograss' turns sticky to slippery in an instant. K Chang, New York Times, Mar. 16, 2004.*

Welters et al. Fast electrically switchable capillary effects. Langmuir 14 (1998) 1535-1538.*

Verheijen et al. Contact angles and wetting velocity measured electrically. Review of Scientific Instruments 70 (1999) 3668-3673.*

Mach et al. Dynamic tuning of optical waveguides with electrowetting pumps and recirculating fluid channels. Applied Physics Letters 81 (2002) 202-204.*

P.A. Cawse, "The Determination of Nitrate in Soil Solutions by Ultraviolet Spectrophotometry" , Analysit, May 1967, vol. 92, pp. 311-315.*

Brenn, Günter. "Concentration fields in drying droplets." Chemical engineering & technology 27.12 (2004): pp. 1252-1258.*

Sung Kwon Cho, Hyejin Moon, and Chang-Jin Kim, "Creating, Transporting, Cutting, and Merging Liquid Droplets by Electrowetting-Based Actuation for Digital Microfluidic Circuits"; Journal of Microelectromechanical Systems, vol. 12, No. 1, Feb. 2003: pp. 70-80.*

Parent case U.S. Appl. No. 11/227,759, entitled "Fluid Oscillations on Structured Surfaces"; to Joanna Aizenberg, et al, filed Sep. 15, 2005.

(56) References Cited

OTHER PUBLICATIONS

Glod et al., "An investigation of microscale explosive vaporization of water on an utrahin Pt wire", International Journal of Heat and Mass Transfer 45 (2002), pp. 367-379.
Four (4) European Search Reports each dated Sep. 15, 2004.
Aizenberg, et al., patent application for "A Low Adsorption Surface" filed Aug. 31, 2005.
Nanotech makes liquids manageable. Energy Optimization News, May 1, 2004.
Tunable surfaces. Physics News 678 (American Institute of Physics), Mar. 26, 2004.
Bell Labs invention could mean cooler chips. A Gonsalves, Techweb Network, Mar. 12, 2004.
Krupenkin et al. Tunable liquid microlens. Applied Physics Letters 82 {2003) 316-318.
Pamula et al. Cooling of integrated circuits using droplet-based microfluidics. Proceedings of the 13th ACM Great Lakes symposium on VLSI, Washington DC, Apr. 28-29, 2003. Proceedings pp. 84-87.
Oprins et al. On-chip liquid cooling with integrated pump technology. Proceedings of the 21st IEEE Semi-Therm Symposium, San Jose, CA, Mar. 15-16, 2005.
Krupenkin et al. 2005. Electrically tunable superhydrophobic nanostructured surfaces. Bell Labs Technical Journal 10(3) (2005) 161-170.
Washizu, Masao, "Electrostatic Actuation of Liquid Droplets for Microreactor Applications," IEEE Transactions on Industry Applications, vol. 34, No. 4, Jul./Aug.1998, pp. 732-737.
Schilling, Andreas et al., Surface Profiles of Reflow Microlenses Under the Influence of Surface Tension and Gravity, Opt. Eng. (39(8) pp. 2171-2176, Society of Photo-Optical Instrumentation Engineers, Aug. 2000.
Danzerbrink, R. et al., "Deposition of Micropatterned Coating Using an Ink-Jet Technique," Thin Solid Films 351, pp. 115-118, Elsevier Science S.A. (1999).
Feng,Chuan Liang et. al., Reversible Wettability of Photoresponsive Flourine-Containing Azobenzene Polymer in Langmuir-Blodgett Films,• Lengmuir vol. 17,No. 15, 2001, pp. 4593-4597, American Chemical Society published on Wah. Jun. 22, 2001.
Ichimura, Kunihiro et al., "Light-Driven Motion of Liquids on a Photoresponsive Surface." Science. vol. 288. Jun. 2, 2000. pp. 1624-1626.
Commander, L.G. et al., "Variable Focal Length Microlenses," Optics Communications 177. Apr. 15, 2000. pp. 157-170.
Aizenberg, J., et al., "Calcitic microlenses as part of the photoreceptor system in brittlestars." Nature. vol. 412. pp. 819-822. Aug. 23, 2001.
English language translation of abstract for German Patent Document: DE 19623270 from European Patent Office database, esp@cenet.com, (1998), 1 page.
Tuberfield, A.J., "Photonic Crystals Made by Holographic Lithography," MRS. Bulletin. Aug. 2001. pp. 632-636.
Campbell, M., et al., "Fabrication of Photonic Crystals for the Visible Spectrum by Holographic Lithography," Nature, vol. 404, Mar. 2, 2000, pp. 53-56.
Ho, K.M., et al., "Existence of a Photonlc Gap in Periodic Dielectric Structures," Physical Review Letters, vol. 65, No. 25, Dec. 17, 1990, pp. 3152-3155.
Ozbay, E., et al., "Measurement of a Three-Dimensional Photonlc Band Gap in a Crystsl Structure Made of Dielectric Rods," PhysicalReview B, vol. 50, No. 3, Jul. 15, 1994, pp. 1945-1948.
Tuberfield, A., "Photonic Crystals Made by Holographic Lithography," Abstract from Symposium K, Microphotonics-Materials, Physics, and Applications, Nov. 26-29, 2001, 1 page.
Shoji, S., et al., "Photofabrication of Three-Dimensional Photonic Crystals by Multibeam Laser Interference Into a Photopolymarizable Resin," Applied Physics Letters, vol. 76, No. 19, May 8, 2000, pp. 2668-2670.
Sundararajan, N., et al., "Supercritical CO2 Processing for Submicron Imaging of Fluoropolymers," Chemistry of Materials, vol. 12, No. 1, Jan. 2000, pp. 41-48.
Kresge, C.T., et al: "Ordered mesoporous molecular sieves synthesized by a liquid-crystal template mechanism" Nature, vol. 359, Oct. 1992, pp. 710-712.
Taney, Peter T., et al: "A Neutral Templating Route to Mesaporous Molecular Sieves," Science, vol. 267, Feb. 1995, pp. 855-867.
Huo, Q. et al: "Generalized synthesis of periodic surfactant/inorganic composite materials," Nature, vol. 368, Mar. 1994, pp. 317-321.
Sanchez, C., et al: "Design and Properties of Hybrid Organic-Inorganic Nanocomposites for Photonics," MRS Bulletin, May 2001, pp. 377-387.
Yang, P., et al: "Hierarchically Ordered Oxides," Science, vol. 282, Dec. 1998, pp. 2244-2246. Templin, M. et al: "Organically Modified Aluminosilicate Mesostructures from Block Copolymer Phases," Science, vol. 278, Dec. 1997, pp. 1795-1798.
Raman, N.K., et al: "Template-Based Approaches to the Preparation of Amorphous, Nanoporous Silicas," Chemical Matter, vol. 8, Feb. 1996, pp. 1682-1701.
Yang, P., et al: "Block Copolymer Templating Synthesis of Mesoporous Metal Oxides with Large Ordering Lengths and Semicrystalline Framework," Chemical Matter, vol. 11, 1999, pp. 2813-2826.
Brinker, C.J., et al., "Evaporation-Induced Self-Assembly: Nanostructures Made Easy**" Advanced Materials, vol. 11, 1999, pp. 579-585.
Lee, Y-J., Braun, P.V., "Tunable Inverse Opal Hydrogel pH Sensors," Adv. Mater. 2003, 15, No. 7-8, Apr. 17, 2003, pp. 563-566.
Arsenault, A.C., et al., "A Polychromic, Fast Response Metallopolymer Gel Photonic Crystal with Solvent and Redox Tunability: A Step Towards Photonic Ink (P-Ink)," Adv. Mater. 2003, 15, No. 6, Mar. 17, 2003, pp. 503-507.
Zhang, S., et al., "Materials and techniques for electrochemical biosensor design and construction," Biosensors & Bioelectronics 15, (2000), pp. 273-282.
Wu, H., et al., "Reduction Photolithography Using Microlens Arrays: Applications in Gray Scale Photolithography," Analytical Chemistry, vol. 74, No. 14, Jul. 15, 2002, pp. 3267-3273.
Leister Microsystems, leaflet by Leister Microsystems entitled, "Micro-optics—Imagine the Future of Light," Sep. 2000, 4 pages.
Stokes, D.L., et al., "Detection of *E. coli* using a microfluidics-based Antibody Biochip detection systems," Fresenius, J. Anal Chem (2001) 369, pp. 295-301.
Jahns, J., et al., "Microoptics for biomedical applications," American Biotechnology Laboratory, No. 18, Oct. 2000, pp. 52 and 54.
Campbell, D.J., et al., "Replication and Compression of Bulk and Surface Structures with Pholydimethylsiloxane Elastomer," Journal of Chemical Education, vol. 75, No. 4, Apr. 1999, pp. 537-541.
Kruk, M., et al., "Mesoporous Silicate-Surfactant Composites with Hydrophobic Surfaces and Tailored Pore Sizes"; Journal of Physical Chemistry 106 B (2002) pp. 10096-10101.
Thrush, E., et al., "Integrated semiconductor fluorescent detection system for biochip and biomedical applications," IEEE-EMBS Special Topic Conference on Microtechnologies in Medicine & Biology, May 2002, pp. 374-379.
Avgeropoulos, et al., "Synthesis and Morphological Behavior of Silicon-Containing Triblock Copolymers for Nanostructure Applications," Chem. Mater. 1998, 10, pp. 2109-2115.
Chan, Vanessa A-H., et al., "Ordered Bicontinuous Nanoporous and Nanorelief Ceramic Films from Self-Assembling Polymer Precursors," Science, Nov. 26, 1999, vol. 286, pp. 1716-1719.
Shishido, A., et al., "Direct fabrication of two-dimensional titania arrays using interference photolithography," Applied Phyiscal Letters, vol. 79, No. 20, Nov. 12, 2001, pp. 3332-3334.
Young, "Organic-Inorganic Monomers," accessed at http://www.psrc.usm.edu/mauritz/nano2.html, Jul. 8, 2002.
Yang, et al., "Creating Periodic Three-Dimensional Structures by Multibeam Interference of Visible Laser," Chemistry of Materials, vol. 14, No. 7, Jul. 2002, pp. 2831-2833.
Vlasov et al., "On-Chip Netural Assembly of Silicon Photonic Bandgap Crystals," Nature, vol. 414, Nov. 15, 2001, pp. 289-293.
Baney, et al., "Silsesquioxanes," American Chemical Society, 1995, pp. 1409-1430.
The Wittman Company, "Carbon Dioxide," published online at http://www.witteman.com/co2.htm, Dec. 4, 2002, 2 pages.

(56) References Cited

OTHER PUBLICATIONS

"Sol-Gel Chemistry," published online at http://www.sol-gel.com/chemi.htm, Dec. 9, 2002, 2 pages.
Abbot, N.L., et al. "Potential-Dependent Wetting of Aqubous Solutions on Self-Assembled Monolayers Formed from 15-(Ferrocenylcarbonyl) Pentadecaneithiol on Gold," Langmuir 1994, American Chemical Society, vol. 10, pp. 1493-1497.
Kim, et al, "Nanostructured Surfaces for Dramatic Reduction of Flow Resistance in Drop[let-Based Microfluidics," IEEE, pp. 479-482 (2002).
E.W. Becker, et al., "Fabrication of microstructures with high aspect ratios and great structural heights by synchrotron radiation lithography, galvanoforming, and plastic moulding (LIGA process)", Microelectronic Engineering, Elsevier Publishers BV., Amsterdam, NL, vol. 4, No. 1 (May 1, 1986), pp. 35-56.
Surface Energy Material (dynes/cm), Accudynete, "Solid Surface Energies," accessed at http://www.accudynetest.com/surface_energy_materials.html, Jul. 27, 2005 (3 pages).
eFunda: General Information on Element Silicon, accessed at http://www.efunda.com/materials/elements/element_info.cfm?Element_ID=Si, Aug. 10, 2005 (8 pages).
Bhardwaj, et al., "Advances in High Rate Silicon and Oxide Etching using ICP", STS Ltd., Imperial Park, Newport, UK NP10 89UJ (6 pages).
Templin, et al., "Organically Modified Aluminosilicate Mesostructrures from block Copolymer Phases", www.sciencemag.org, Science, vol. 278, Dec. 5, 1997, pp. 1795-1798.

* cited by examiner

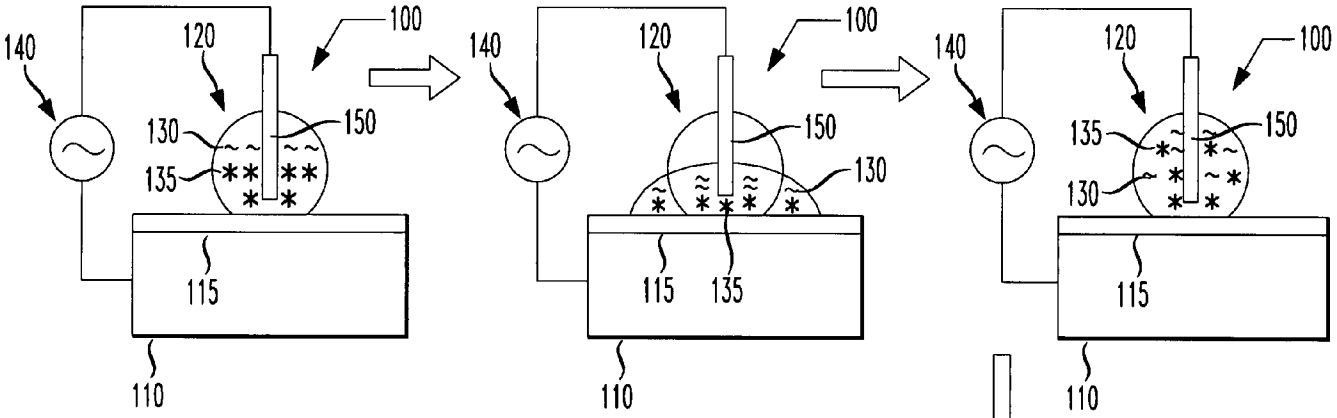
FIG. 1A
FIG. 1B
FIG. 1C
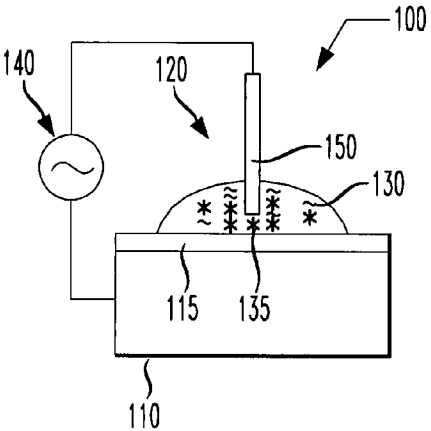
FIG. 1D
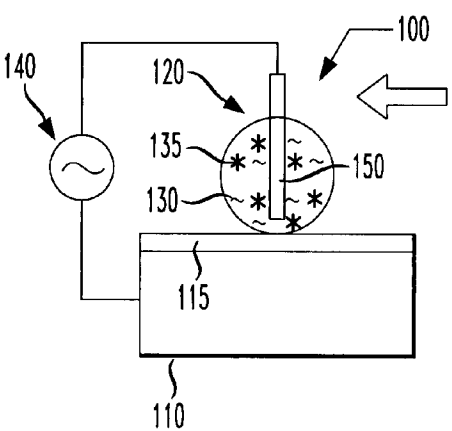
FIG. 1E

MICRO-CHEMICAL MIXING

CROSS REFERENCE TO RELATED APPLICATION

This application is a continuation-in-part of U.S. patent application Ser. No. 11/227,759, entitled "FLUID OSCILLATIONS ON STRUCTURED SURFACES", filed on Sep. 15, 2005. The above-listed application is commonly assigned with the present invention and is incorporated herein by reference as if reproduced herein in its entirety.

TECHNICAL FIELD OF THE INVENTION

The present invention is directed, in general, to a device and a method for mixing two or more species within a droplet.

BACKGROUND OF THE INVENTION

One problem encountered when handling small fluid volumes is to effectively mix different fluids together. For instance, poor mixing can occur in droplet-based microfluidic devices, where the fluids are not confined in channels. In droplet based systems, small droplets of fluid (e.g., fluid volumes of about 100 microliters or less) are moved and mixed together on a surface. In some cases, it is desirable to add a small volume of a reactant to a sample droplet to facilitate the analysis of the sample, without substantially diluting it. In such cases, there is limited ability to mix the two fluids together because there is no movement of the fluids to facilitate mixing.

Embodiments of the present invention overcome these problems by providing a device and method that facilitates the movement and mixing of small volumes of fluids.

SUMMARY OF THE INVENTION

To address the above-discussed deficiencies of the prior art, the present invention provides a method. The method comprises providing a droplet having a first chemical species and a second chemical species on a substrate, and applying a voltage across the droplet to physically repeatedly deform the droplet. In this embodiment, the applying causes the droplet to move with respect to an object located therein and at least partially mix the first chemical species and the second chemical species.

In an alternative embodiment, the method includes providing a droplet over a substrate, injecting a chemical species within the droplet and applying a voltage across the droplet. In this embodiment the injecting and applying use a same object.

Yet another embodiment of the present invention includes a device. The device, without limitation, includes a substrate having a droplet thereover, and an electrical source coupleable to the substrate, the electrical source configured to apply a voltage between the substrate and the droplet using an electrode, wherein the electrode has a first portion and a second portion non-symmetric to the first portion, the first and second portions defined by a plane located normal to a longitudinal axis and through a midpoint of a length of the electrode.

BRIEF DESCRIPTION OF THE DRAWINGS

The invention is best understood from the following detailed description when read with the accompanying FIGUREs. It is emphasized that, in accordance with the standard practice in the semiconductor industry, various features are not drawn to scale. In fact, the dimensions of the various features may be arbitrarily increased or reduced for clarity of discussion. Reference is now made to the following descriptions taken in conjunction with the accompanying drawings, in which:

FIGS. 1A thru 1E illustrate cross-sectional views of a device while undergoing a process for mixing two or more species within a droplet in accordance with the principles of the present invention;

DETAILED DESCRIPTION

Figure 2B:
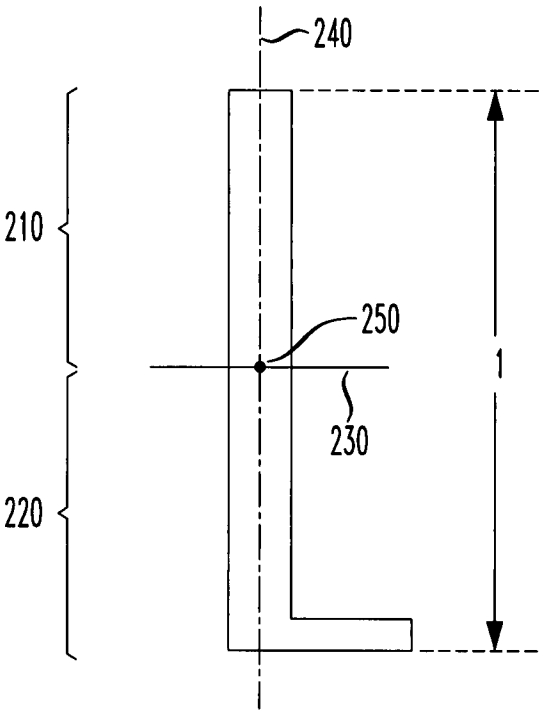
FIGS. 2A thru 2D illustrate different objects, in this embodiment electrodes, that might be used in place of the object illustrated in FIGS. 1A thru 1E.
Figure 2A:
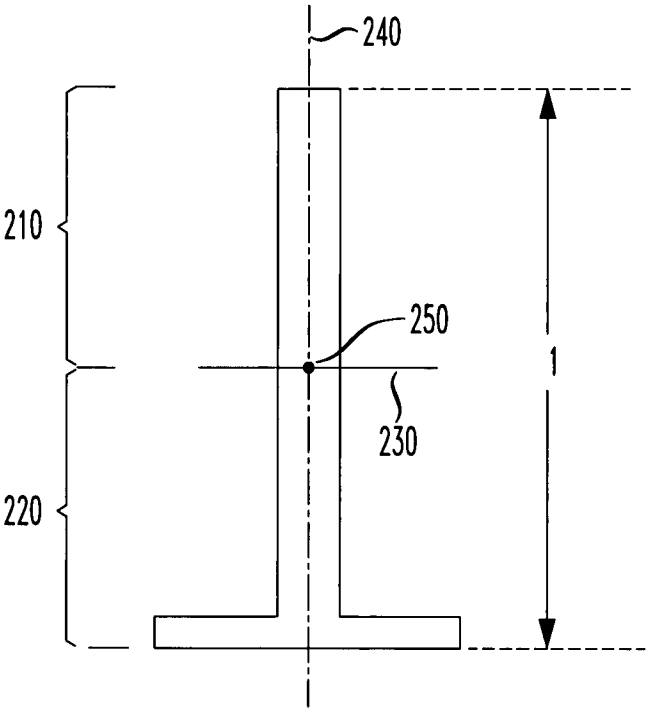
Figure 2D:
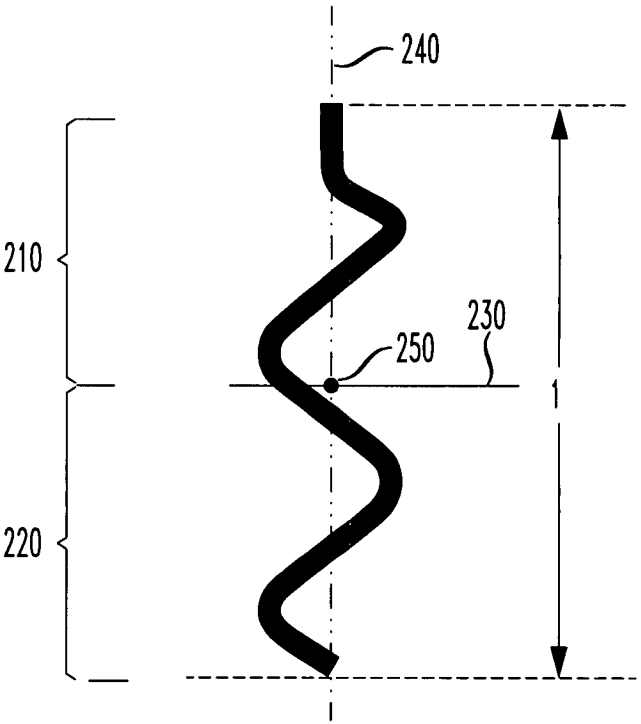
Figure 2C:
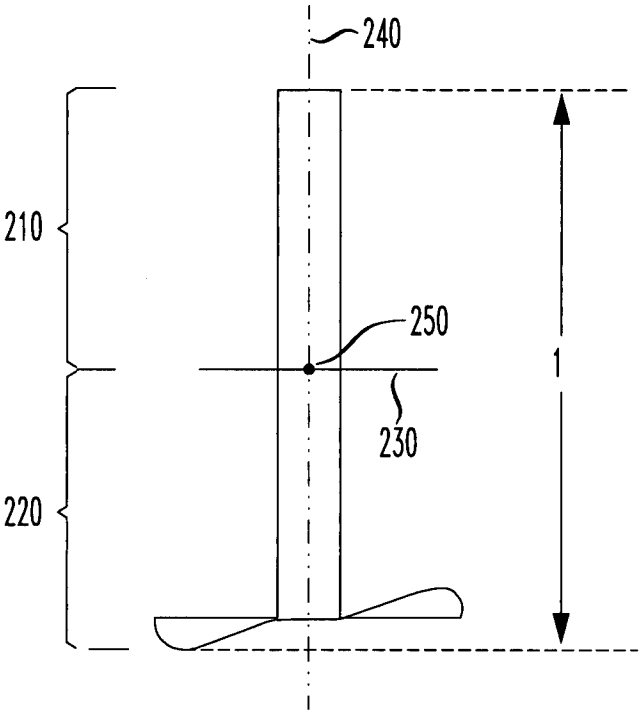

The present invention recognizes that the vertical position of a droplet (e.g., a droplet of fluid) can be made to oscillate on certain kinds of substrates. In certain embodiments, the vertical position of the droplet can be made to oscillate on a conductive substrate having fluid-support-structures thereon. The application of a voltage between the substrate and the droplet may cause the droplet to alternate between a state with a high contact angle (e.g., a less flattened configuration or a non-wetted state) and a state with a lower contact angle (e.g., a more flattened configuration or a wetted state). In such embodiments the substrate comprises a pattern of fluid-support-microstructures, the applied voltage causing a surface of the droplet to move between tops of the fluid-support-microstructures and the substrate on which the microstructures are located. Such movements cause the droplet to move between effective more flattened and less flattened states, respectively.

As part of the present invention, it was further discovered that repeatedly deforming (e.g., oscillating) the droplet in this manner promotes mixing of two or more species (e.g., chemical species) within the droplet. For instance, the repeated deformation of the droplet can induce motion within the droplet, thereby promoting mixing of the two or more species of fluids. Without being limited to such, it is believed that the movement of the droplet with respect to an object located therein promotes the mixing, the object may for example be an electrode used to provide the voltage.

Turning now to FIGS. 1A thru 1E illustrated are cross-sectional views of a device 100 while a droplet undergoes a process for mixing two or more species therein in accordance with the principles of the present invention. The device 100 of FIGS. 1A thru 1E initially includes a substrate 110. The substrate 110 may be any layer located within a device and having properties consistent with the principles of the present invention. For instance, in one exemplary embodiment of the present invention the substrate 110 is a conductive substrate.

Some preferred embodiments of the conductive substrate 110 comprise silicon, metal silicide, or both. In some preferred embodiments, for example, the conductive substrate 110 comprises a metal silicide such as cobalt silicide. However, other metal silicides, such as tungsten silicide or nickel silicide, or alloys thereof, or other electrically conductive materials, such as metal films, can be used.

In the embodiment wherein the substrate 110 is a conductive substrate, an insulator layer 115 may be disposed thereon. Those skilled in the art understand the materials that could comprise the insulator layer 115 while staying within the scope of the present invention. It should also be noted that in various embodiments of the present invention, one or both of the substrate 110 or insulator layer 115 has hydrophobic properties. For example, one or both of the substrate 110 or insulator layer 115 might at least partially comprise a low-surface-energy material. For the purposes of the present invention, a low-surface-energy material refers to a material having a surface energy of about 22 dyne/cm (about $22\times10^{-5}$ N/cm) or less. Those of ordinary skill in the art would be familiar with the methods to measure the surface energy of such a material. In some preferred embodiments, the low-surface-energy material comprises a fluorinated polymer, such as polytetrafluoroethylene, and has a surface energy ranging from about 18 to about 20 dyne/cm.

Located over the substrate 110 in the embodiment shown, and the insulator layer 115 if present, is a droplet 120. The droplet 120 may comprise a variety of different species and fluid volumes while staying within the scope of the present invention. In one exemplary embodiment of the present invention, however, the droplet 120 has a fluid volume of about 100 microliters or less. It has been observed that the methodology of the present invention is particularly useful for mixing different species located within droplets 120 having fluid volumes of about 100 microliters or less. Nevertheless, the present invention should not be limited to any specific fluid volume.

Located within the droplet 120 in the embodiments of FIGS. 1A thru 1E are a first species 130 and a second species 135. For the purpose of illustration, the first species 130 is denoted as (~) and the second species is denoted as (*). The first species 130 may be a diluent or a reactant. Similarly, the second species 135 may be a diluent or a reactant. In the exemplary embodiment shown, however, the first species 130 is a first reactant and the second species 135 is a second reactant, both of which are suspended within a third species, such as a diluent.

Some preferred embodiments of the device 100 also comprise an electrical source 140 (e.g., an AC or DC voltage source) coupled to the substrate 110 and configured to apply a voltage between the substrate 110 and the droplet 120 located thereover. In the illustrative embodiment of FIGS. 1A thru 1E, the electrical source 140 uses an object 150, such as an electrode, to apply the voltage. While the embodiment of FIGS. 1A thru 1E illustrates that the object 150 is located above the substrate 110, other embodiments exist wherein the object 150 contacts the droplet 120 from another location, such as from below the droplet 120. Those skilled in the art understand how to configure such an alternative embodiment. Moreover, as will be discussed more fully below, the object 150 may take on a number of different configurations and remain within the purview of the present invention.

Given the device 100 illustrated in FIGS. 1A thru 1E, the first species 130 and the second species 135 may be at least partially mixed within the droplet 120 using the inventive aspects of the present invention. Turning initially to FIG. 1A, the droplet is positioned in its less flattened state. For instance, because substantially no voltage is applied between the substrate 110 and the droplet 120, the droplet is in its natural configuration. It should be noted that the first species 130 and the second species 135 located within the droplet of FIG. 1A are substantially, if not completely, separated from one another.

Turning now to FIG. 1B, illustrated is the device 100 of FIG. 1A, after applying a non-zero voltage between the substrate 110 and the droplet 120 using the electrical source 140 and the object 150. As would be expected, the droplet 120 moves to a flattened state, and thus is in its deformed configuration. It is the movement of the object 150 within the droplet 120 that is believed to promote the mixing of the first species 130 and the second species 135. It should be noted, however, that other phenomena might be responsible for at least a portion of the mixing.

In some cases, the electrical source 140 is configured to apply a voltage ranging from about 1 to about 50 Volts. It is sometimes desirable for the voltage to be applied as a brief pulse so that the droplet 120 after becoming flattened can bounce back up to its less flattened state. In some cases, the applied voltage is a series of voltage pulses applied at a rate in the range from about 1 to 100 Hertz, and more preferably from about 10 to 30 Hertz. In other cases, the applied voltage is an AC voltage. In some preferred embodiments, the AC voltage has a frequency in the range from about 1 to about 100 Hertz. One cycle of droplet oscillation is defined to occur when the droplet 120 makes a round-trip change from the less flattened state to the more flattened state and back up to the less flattened state, or from the more flattened state to the less flattened state and back down to the more flattened state. Take notice how the first species 130 and the second species 135 in the embodiment of FIG. 1B are slightly more mixed within the droplet 120 than the first species 130 and second species 135 in the droplet 120 of FIG. 1A.

Turning now to FIG. 1C, illustrated is the device 100 of FIG. 1B after removing the voltage being applied via the electrical source 140 and object 150. Thus, the droplet 120 substantially returns to its less flattened state, and has therefore made one complete cycle of movement. As one would expect based upon the disclosures herein, the movement from the more flattened state of FIG. 1B to the less flattened state of FIG. 1C may promote additional mixing. Accordingly, the first species 130 and second species 135 may be more mixed in the droplet 120 of FIG. 1C than the droplet 120 of FIG. 1B.

Moving on to FIGS. 1D and 1E, the droplet 120 undergoes another cycle of movement, thus further promoting the mixing of the first species 130 and second species 135 therein. In accordance with the principles of the present invention, the droplet 120 may repeatedly be deformed, until a desired amount of mixing between the first species 130 and the second species 135 has occurred. The number of cycles, and thus the amount of mixing between the first species 130 and the second species 135, may be based upon one or both of a predetermined number of cycles or a predetermined amount of time. In any event, addition mixing typically occurs with each cycle, at least until the first species 130 and second species 135 are completely mixed.

Uniquely, the present invention uses the repeated deformation of the droplet 120 having the object 150 therein to accomplish mixing of the first species 130 and second species 135 within the droplet 120. Accordingly, wherein most methods for mixing the species within the droplet would be based upon the relative movement of the object 150 with respect to the droplet 120, the present invention is based upon the movement of the droplet 120 with respect to the object 150. For instance, in most preferred embodiments the object 150 is fixed, and thus stationary, and it is the movement of the droplet 120 using the electrical source 140 that promotes the movement.

This being said, the method disclosed herein provides what is believed to be unparalleled mixing for two or more species within a droplet. Namely, the method disclosed herein in capable of easily mixing two or more species that might be located within a droplet having a fluid volume of about 100 microliters or less. Prior to this method, easy mixing of such small volumes was difficult, at best.

In various embodiments, the object 150 is positioned asymmetric along the axis of motion of the droplet being physically distorted. For example, the object 150 may be positioned a non-zero angle away from the direction of movement of the droplet during mixing. This non-zero angle might be used to introduce increased mixing.

The embodiments of FIGS. 1A thru 1E are droplet based micro fluidic system. It should be noted, however, that other embodiments might consist of micro channel based micro fluidic systems, wherein the droplet might be located within a channel and the mixing occurring within one or more channels, as opposed to that shown in FIGS. 1A thru 1E. Those skilled in the art understand just how the inventive aspects of the present invention could be employed with such a micro channel based micro fluidic system.

Turning now to FIGS. 2A thru 2D, illustrated are different objects 200, in this embodiment electrodes, that might be used in place of the object 150 illustrated in FIG. 1A thru 1E. Specifically, the objects 200 illustrated in FIGS. 2A thru 2D each have a first portion 210 and a second portion 220 non-symmetric to the first portion 210. In these embodiments, the first and second portions 210, 220, are defined by a plane 230 located normal to a longitudinal axis 240 and through a mid-point 250 of a length (l) of the object 200. As is illustrated in FIGS. 2A thru 2D, the first portion 210 located above the plane 230 is non-symmetric to the second portion 220 located below the plane 230.

To accomplish the aforementioned non-symmetric nature of the object 200, the object 200 may take on many different shapes. For example, the object 200 of FIG. 2A comprises an inverted T, or depending on the view, a disk disposed along a shaft. Alternatively, the object 200 of FIG. 2B comprises an L, the object 200 of FIG. 2C comprises a propeller and the object 200 of FIG. 2D comprises a helix. Each of the different shapes of FIGS. 2A thru 2D provide increased mixing when the droplet moves with respect to the object as discussed with respect to FIGS. 1A thru 1E above, at least as compared to the symmetric object 150 illustrated in FIGS. 1A thru 1E. For instance, what might take a first species about 10 minutes to mix with a second species using only simple diffusion, might only take about 1 minute using the object 150 illustrated in FIGS. 1A thru 1E, and further might only take about 15 seconds using an object similar to the object 200 illustrated in FIG. 2D. Thus, the object 150 of FIGS. 1A thru 1E might provide about 10 times the mixing as compared to passive diffusion, whereas the objects 200 of FIGS. 2A thru 2D might provide about 30 times the mixing as compared to passive diffusion. Obviously, the aforementioned improvements are representative only, and thus should not be used to limit the scope of the present invention.

Figure 3:
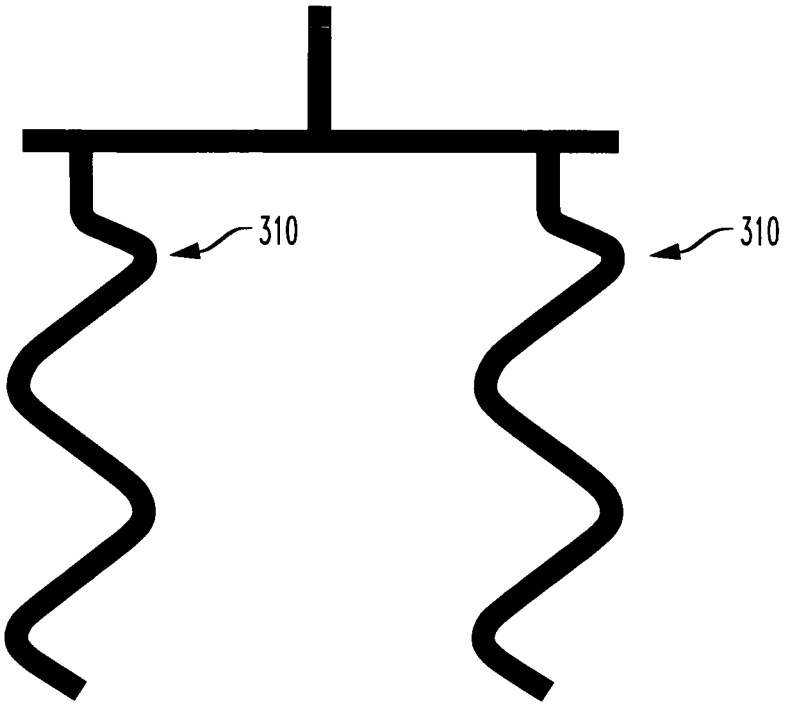
FIG. 3 illustrates an alternative embodiment of an object that might be used with the methodology discussed above with respect to FIGS. 1A thru 1E.

Turning briefly to FIG. 3, illustrated is an alternative embodiment of an object 300 that might be used with the methodology discussed above with respect to FIGS. 1A thru 1E. The object 300 of FIG. 3, as compared to the objects 150, 200 of FIGS. 1A thru 1E and 2A thru 2D, respectively, comprises multiple vertical sections 310. The vertical sections 310 attempt to create a swirling effect within the droplet, thereby providing superior mixing of the two or more species. While each of the vertical sections 310 illustrated in FIG. 3 are shown as helix structures, similar to the object 200 of FIG. 2D, other embodiments exist wherein each of the vertical sections 310 are similar to any one of the shapes illustrated in previous FIGURES, as well as other shapes neither disclosed nor shown.

Figure 4:
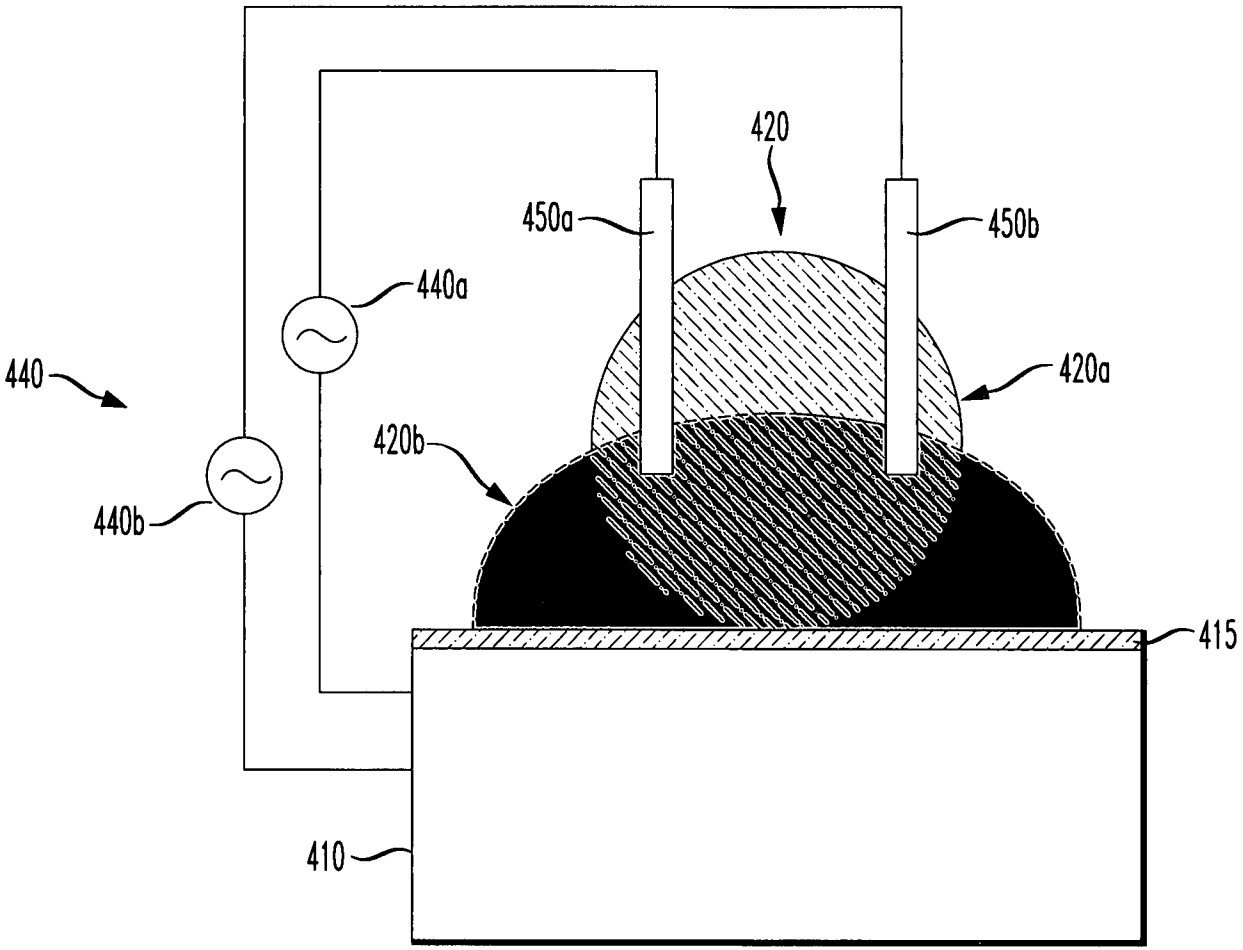
FIG. 4 illustrates a cross-sectional view of an alternative embodiment of a device while undergoing a process for mixing two or more species within a droplet in accordance with the principles of the present invention

Turning now to FIG. 4, illustrated is a cross-sectional view of an alternative embodiment of a device 400 while undergoing a process for mixing two or more species within a droplet in accordance with the principles of the present invention. The device 400 of FIG. 4 is substantially similar to the device 100 illustrated in FIGS. 1A thru 1E, with the exception that multiple objects 450*a* and 450*b* are positioned at different locations within the droplet 420. In an exemplary embodiment, each one of the multiple objects 450*a* and 450*b* is an individually addressable electrode. For instance, each one of the multiple objects 450*a* and 450*b* may be connected to different electrical sources 440*a* and 440*b*, respectively, thereby providing the ability to address them individually. In an alternative embodiment, each one of the multiple objects 450*a* and 450*b* could be connected to the same electrical source 440, whether it be a fixed or variable electrical source, and switches could be placed between the electrical source 440 and each one of the multiple objects 450*a* and 450*b*. Thus, the switches would allow for the ability to address each one of the multiple objects 450*a* and 450*b* individually.

The device 400 of FIG. 4 might be operated by alternately applying a voltage between the multiple objects 450*a* and 450*b*. In such an operation, an additional in-plane oscillation of the droplet 420 between the multiple objects 450*a* and 450*b* might occur. Accordingly, wherein the device 100 of FIGS. 1A thru 1E might only cause the droplet 120 to move normal to the surface on which it rests, the device 400 of FIG. 4 might cause the droplet 420 to have this additional in-plane movement (e.g., along the surface on which it rests). As those skilled in the art appreciate, this additional in-plane movement may induce increased mixing, at least as compared to the movement created in the droplet 120 of FIGS. 1A thru 1E.

As an extension of this point, those skilled in the art could design certain more complex geometries, with numerous addressable objects, to ensure rigorous mixing due to the induced movement of the droplet in the different directions. For example, such rigorous mixing might be induced using a device having its objects positioned as follows:

A

B C D

E

By using the combination of these five independent objects (e.g., electrodes A, B, C, D and E) one can either induce normal up and down movement of the droplet by applying a voltage to object C (such as is illustrated with respect to FIGS. 1A thru 1E), induce an in-plane movement of the droplet by applying an alternating voltage between objects A and E or B and D (such as is illustrated with respect to FIG. 4 above), or induce a spinning movement of the droplet by sequentially applying a voltage to objects A, B, E and D. Obviously, other complex geometries might provide even more significant mixing.

Figure 5:
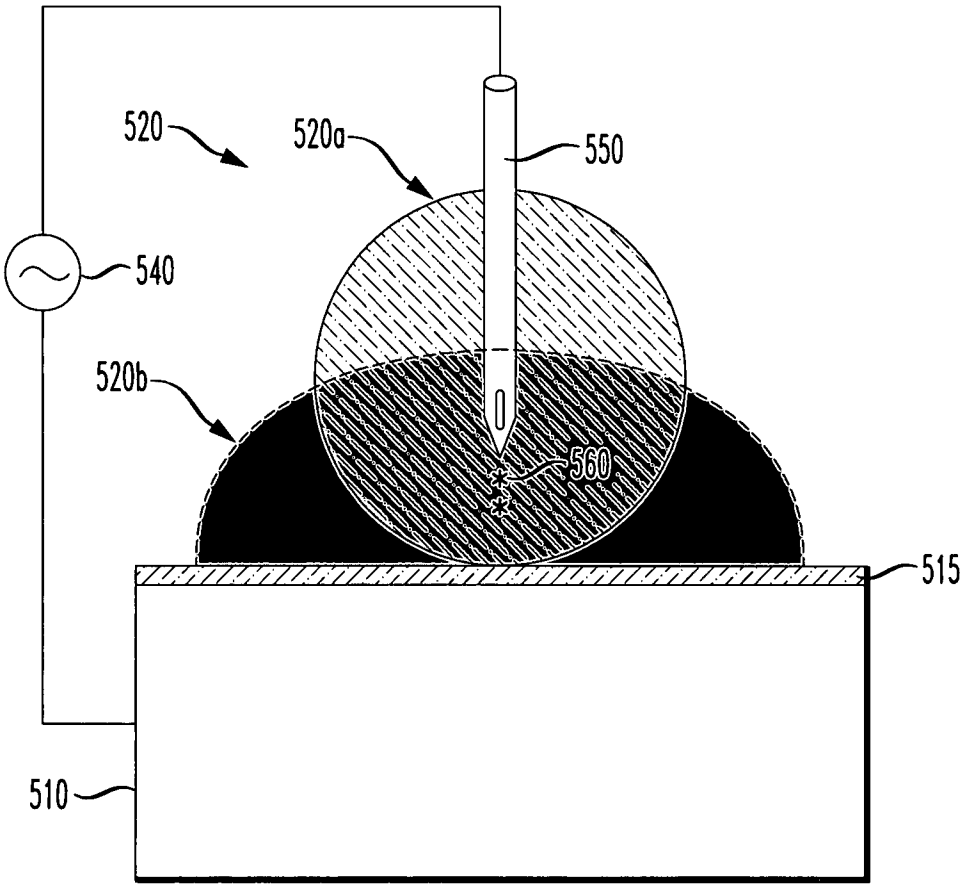
FIG. 5 illustrates an alternative embodiment of a device in accordance with the principles of the present invention.

Turning now to FIG. 5, illustrated is an alternative embodiment of a device 500 in accordance with the principles of the present invention. The embodiment of the device 500 includes a substrate 510, an insulator layer 515, a droplet 520 (in both a less flattened state 520*a* and a more flattened state 520*b*), an electrical source 540 and an object 550. In this embodiment, the object 550 is both configured to act as a hollow needle, and thus is configured to supply one or more species 560 to the droplet 520, and well as configured to apply a voltage across the droplet 520. Thus, in the embodiment shown, the object 550 is an electrode also configured as a hollow needle, or vice-versa.

Those skilled in the art understand the many different shapes for the object 550 that might allow the object 550 to function as both the electrode and the needle. For that matter, in addition to a standard needle shape, each of the shapes illustrated in FIGS. 2A thru 2D could be configured as a needle, thus providing both functions. Other shapes could also provide both functions and remain within the purview of the present invention.

It should also be noted that rather than the object 550 being configured as a single needle having a single fluid channel to provide a species 560, the object 550 could comprise a plurality of fluid channels to provide a plurality of different species 560 to the droplet 520. For example, in one embodiment, the object 550 comprises a cluster of different needles, each different needle having its own fluid channel configured to provide a different species 560. In another embodiment, however, the object 550 comprises a single needle, however the single needle has a plurality of different fluid channels for providing the different species 560. Other configurations, which are not disclosed herein for brevity, could nevertheless also be used to introduce different species 560 within the droplet 520. The above-discussed embodiments are particularly useful wherein there is a desire to keep the different species separate from one another, such as wherein the two species might undesirably react with one another.

The device 500 including the object 550 may, therefore, be used to include any one or a collection of species 560 within the droplet 520. The object 550 may, in addition to the ability to provide one or more species 560 within the droplet 520, also function as an electrode to move the droplet 520 using electrowetting, mix two or more species within the droplet 520 using the process discussed above with respect to FIGS. 1A thru 1E, or any other known or hereafter discovered process.

Figure 6:
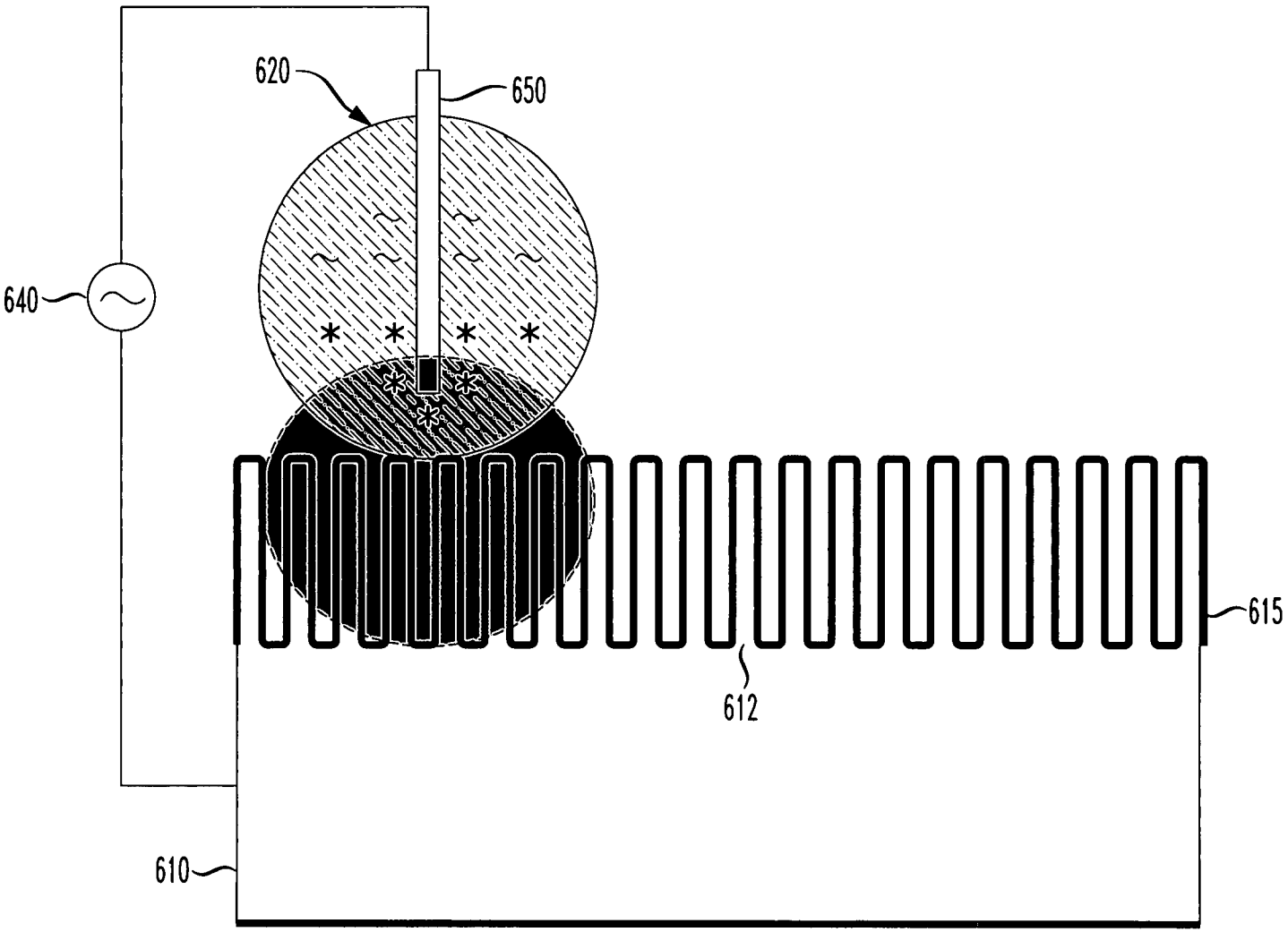
FIG. 6 illustrates a cross-sectional view of an alternative embodiment of a device while undergoing a process for mixing two or more species within a droplet in accordance with the principles of the present invention.

Turning now to FIG. 6, illustrated is a cross-sectional view of an alternative embodiment of a device 600 while undergoing a process for mixing two or more species within a droplet in accordance with the principles of the present invention. The device 600 of FIG. 6 initially includes a substrate 610. The device 600 also includes fluid-support-structures 612 that are located over the substrate 610. Each of the fluid-support-structures 612, at least in the embodiment shown, has at least one dimension of about 1 millimeter or less, and in some cases, about 1 micron or less. As those skilled in the art appreciate, the fluid-support-structures 612 may comprise microstructures, nanostructures, or both microstructure and nanostructures.

In some instances, the fluid-support-structures 612 are laterally separated from each other. For example, the fluid-support-structures 612 depicted in FIG. 6 are post-shaped, and more specifically, cylindrically shaped posts. The term post, as used herein, includes any structures having round, square, rectangular or other cross-sectional shapes. In some embodiments of the device 600, the fluid-support-structures 612 form a uniformly spaced array. However, in other cases, the spacing is non-uniform. For instance, in some cases, it is desirable to progressively decrease the spacing between fluid-support-structures 612. For example, the spacing can be progressively decreased from about 10 microns to about 1 micron in a dimension.

In the embodiment shown, the fluid-support-structures 612 are electrically coupled to the substrate 610. Moreover, each fluid-support-structure 612 is coated with an electrical insulator 615. One suitable insulator material for the electrical insulator 615 is silicon dioxide.

Exemplary fluid-support micro-structures and patterns thereof are described in U.S. Patent Application Publs.: 20050039661 of Avinoam Kornblit et al. (publ'd Feb. 24, 2005), U.S. Patent Application Publ. 20040191127 of Avinoam Kornblit et al. (publ'd Sep. 30, 2004), and U.S. Patent Application Publ. 20050069458 of Marc S. Hodes et al. (publ'd Mar. 31, 2005). The above three published U.S. Patent Applications are incorporated herein in their entirety.

The device 600 of FIG. 6 further includes a droplet 620 located over the substrate 610 and the fluid-support-structures 612. In the embodiment shown, the droplet 620 is resting on a top surface of the fluid-support-structures 612. The device 600 may further include an electrical source 640 and an object 650. The substrate 610, electrical insulator 615, droplet 620, electrical source 640 and object 650 may be similar to their respective features discussed above with regard to previous FIGUREs.

As those skilled in the art would expect, at least based upon the aforementioned discussions with respect to FIGS. 1A thru 1E, FIGS. 2A thru 2D, and FIGS. 3, 4 and 5, the device 600 may be configured to oscillate the droplet 620 between the tops of the fluid-support-structures 612 and the substrate 610, when a voltage is applied between the substrate 610 and the droplet 620 using the electrical source 640 and the object 650. For example, the device 600 can be configured to move the droplet 620 vertically, such that a lower surface of the droplet 620 moves back and forth between the tops of the fluid-support-structures 612 and the substrate 610 in a repetitive manner.

Figure 7:
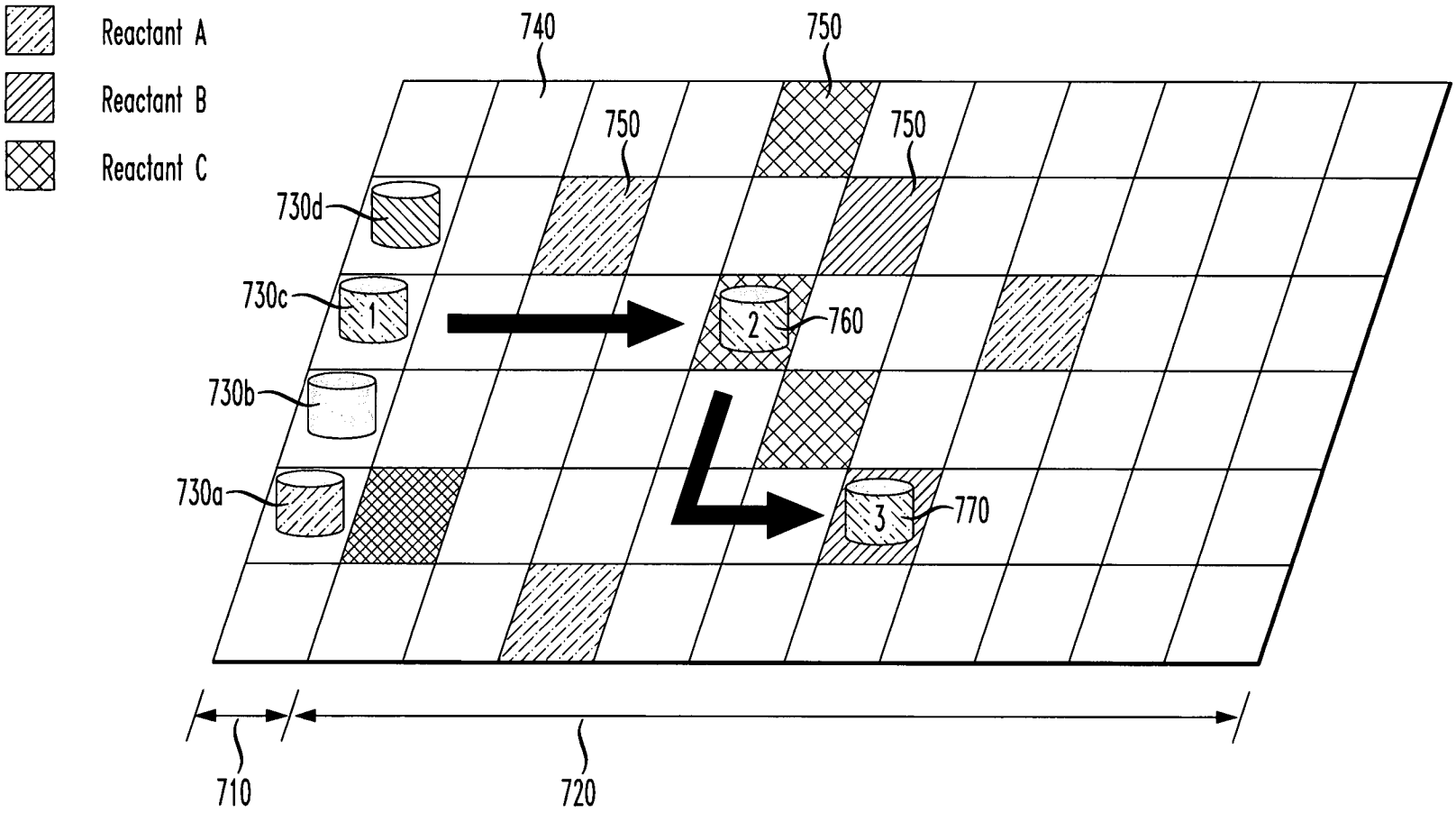
FIG. 7 illustrates one embodiment of a mobile diagnostic device in accordance with the principles of the present invention.

Based upon all of the foregoing, it should be noted that the present invention, and all of the embodiments thereof, might be used with, among others, a mobile diagnostic device such as a lab-on-chip or microfluidic device. Turning briefly to FIG. 7, illustrated is one embodiment of a mobile diagnostic device 700 in accordance with the principles of the present invention. The mobile diagnostic device 700 illustrated in FIG. 7 initially includes a sample source region 710 and a chemical analysis region 720. As is illustrated in FIG. 7, the sample source region 710 may include a plurality of droplets 730, in this instance four droplets 730*a*, 730*b*, 730*c*, and 730*d*. As is also illustrated in FIG. 7, the chemical analysis region 720 may include a plurality of both blank pixels 740 and reactant pixels 750.

The device 700 of FIG. 7, as shown, may operate by moving the droplets 730 across the chemical analysis region 720, for example using electrowetting. As the droplets 730 encounter a reactant pixel 750, a voltage may be applied across the substrate and the droplet 730, thereby causing the droplet 730 to move to a more flattened state (e.g., wetted state in certain embodiments), and thus come into contact with the reactant located within that particular reactant pixel. The reactant in the pixel may be of a liquid form or a solid form. For example, the reactant may be in a solid form, and thus dissolved or adsorbed by the droplet 730.

This process is illustrated using the droplet 730*c*. For example, the droplet 730*c* is initially located at a position 1. Thereafter, the droplet 730*c* is moved laterally using any known or hereafter discovered process wherein it undergoes an induced reaction 760 at position 2. The induced reaction 760, in this embodiment, is initiated by applying a non-zero voltage between the substrate and the droplet 730*c*, thereby causing the droplet 730*c* to move to a more flattened state, and thus come into contact with the reactant in that pixel. Thereafter, as shown, the droplet 730*c* could be moved to a position 3, wherein it undergoes another induced reaction 770.

It should be noted that while the droplets 730 are located at any particular location, the droplets 730 may be repeatedly deformed in accordance with the principles discussed above with respect to FIGS. 1A thru 1E. Accordingly, the reactant acquired during the induced reactions 760, 770, may be easily mixed using the process originally discussed above with respect to FIGS. 1A thru 1E.

In certain embodiments, each of the droplets 730 has its own object, and thus the droplets can be independently repeatedly deformed. In these embodiments, each of the objects could be coupled to an independent AC voltage supply, or alternatively to the same AC voltage supply, to induce the mixing. Each of the mentioned objects could also be configured as a needle, and thus provide additional reactant species to the drops, such as discussed above with respect to FIG. 5. Those skilled in the art understand the other ideas that might be used with the device 700.

Although the present invention has been described in detail, those skilled in the art should understand that they could make various changes, substitutions and alterations herein without departing from the spirit and scope of the invention in its broadest form.

What is claimed is:

1. A method, comprising:

providing a droplet having a first chemical species and a second different chemical species on a substrate, the first chemical species and the second chemical species having a concentration gradient with respect to each other;

applying a voltage across the droplet to physically repeatedly deform the droplet in a direction substantially perpendicular to the substrate, wherein the applying causes the droplet to move at least two full cycles between less flattened and more flattened states with respect to an object located therein and while the object is located therein and thereby at least partially mix the first chemical species with the second chemical species thereby changing the concentration gradient.

2. The method as recited in claim 1 wherein the object has a first portion and a second portion non-symmetric to the first portion, the first and second portions defined by a plane located normal to a longitudinal axis and through a midpoint of a length of the object.

3. The method as recited in claim 1 wherein the object is an electrode.

4. The method as recited in claim 1 wherein the object is a needle configured to provide the first chemical species.

5. The method as recited in claim 1 wherein the object is shaped as a helix.

6. The method as recited in claim 1 wherein a shape of the object is selected from the group consisting of:

an inverted T;

an L;

a disk disposed along a shaft; and a propeller.

7. The method as recited in claim 1 wherein the object is positioned as to be asymmetric along an axis of motion of the droplet as the droplet is physically distorted.

8. The method as recited in claim 1 wherein the substrate comprises a fluid-support-structure having at least one dimension of about 1 millimeter or less, and wherein applying a voltage causes the droplet to move between a top of the fluid-support-structure and a base of the fluid-support-structure.

9. The method as recited in claim 1 wherein the droplet is a first droplet and further including providing a second droplet having a third chemical species and a fourth chemical species over the substrate, and applying a voltage across the second droplet to physically repeatedly deform the second droplet, wherein the applying causes the second droplet to move with respect to a second object located therein and at least partially mix the third chemical species and the fourth chemical species.

10. The method as recited in claim 9 wherein the first droplet and the second droplet form at least a portion of a lab on a chip.

11. A method, comprising:

providing a droplet over a substrate; and injecting a chemical species within the droplet by inserting an object therein, the chemical species not previously within the droplet;

applying a voltage across the droplet using the same object.

12. The method as recited in claim 11 wherein the object is an electrode configurable as a needle.

13. The method as recited in claim 11 wherein the injecting occurs before, during or after the applying.

14. The method as recited in claim 11 wherein the substrate is a hydrophobic substrate.

15. The method as recited in claim 11 wherein the substrate comprises a fluid-support-structure having at least one dimension of about 1 millimeter or less, and wherein applying a voltage causes the droplet to move between a top of the fluid-support-structure and a base of the fluid-support-structure.

16. The method as recited in claim 11 wherein a fluid volume of the droplet is about 100 microliters or less.

17. The method as recited in claim 11 wherein the chemical species is a reactant.

18. A method, comprising:

providing a droplet including a first chemical species over a substrate; and injecting a second different chemical species within the droplet by inserting an object therein, the second different chemical species not previously within the droplet;

applying a voltage across the droplet using the same object.

19. The method as recited in claim 1 wherein the second chemical species is a reactant.

20. The method as recited in claim 18 wherein the second chemical species is a reactant.

21. The method as recited in claim 19 wherein the at least partially mixing the first chemical species with the second chemical species thereby changing the concentration gradient includes reacting the first and second species.

* * * * *